US005637026A

United States Patent [19]

Lakusiewicz

[11] Patent Number: 5,637,026

[45] Date of Patent: Jun. 10, 1997

[54] ORTHOTIC EPAULET FOR ALLEVIATING DISCOMFORT FROM BRASSIERE STRAPS

[76] Inventor: Ronald J. Lakusiewicz, 1316 Euel Rd., Poplar Bluff, Mo. 63901

[21] Appl. No.: 462,578

[22] Filed: Jun. 5, 1995

[51] Int. Cl.[6] ..... A41D 27/26

[52] U.S. Cl. ..... 450/86; 2/268

[58] Field of Search ..... 450/86, 87, 88; 2/1, 2, 2.5, 267, 268, 244

[56] References Cited

U.S. PATENT DOCUMENTS

| | | | |
|---|---|---|---|
| 661,935 | 11/1900 | Löwenthal | 2/268 |
| 1,631,694 | 6/1927 | Rick . | |
| 2,402,292 | 6/1946 | Nichols | 2/268 |
| 2,483,809 | 10/1949 | Clark et al. | 2/268 |
| 2,492,890 | 12/1949 | Sameth | 2/268 |
| 2,501,749 | 3/1950 | Trent | 2/2 |
| 2,505,272 | 4/1950 | Blalock et al. | 2/336 |
| 2,671,223 | 3/1954 | Axsom | 2/268 |
| 3,229,694 | 1/1966 | Koropp | 128/510 |
| 4,612,935 | 9/1986 | Greifer | 2/268 X |
| 4,795,399 | 1/1989 | Davis | 450/86 |
| 4,795,400 | 1/1989 | Greenberg | 450/86 |
| 4,894,868 | 1/1990 | Christopher | 2/268 |
| 4,945,576 | 8/1990 | Melton | 2/268 |
| 5,155,869 | 10/1992 | Ralli et al. | 2/268 |
| 5,201,078 | 4/1993 | Melton | 2/268 |
| 5,240,538 | 8/1993 | Hyams et al. | 156/245 |

FOREIGN PATENT DOCUMENTS

| | | | |
|---|---|---|---|
| 2536230 | 2/1976 | Germany | 2/268 |
| 231879 | 6/1925 | United Kingdom | 2/268 |

*Primary Examiner*—Jeanette E. Chapman

*Attorney, Agent, or Firm*—Armstrong, Teasdale, Schlafly & Davis

[57] ABSTRACT

An orthotic epaulet adapted to be worn on the shoulder to alleviate discomfort caused by brassiere straps. The epaulet comprises a panel of a flexible materials having a smoothly contoured perimeter, the panel being smoothly curved across a transverse ridge line to form a concave contact surface on the underside of the panel adapted to fit over the user's shoulder, and a convex bearing surface on the top surface of the panel, with the ridge line extending along the ridge of the wearer's shoulder. A strip of a pile material extending transversely across the ridge line on convex bearing surface of the panel, to engage a brassiere strap worn over the shoulder. The panel has an anterior flange adapted to overlie the anterior portion of the shoulder on which the epaulet is worn, and a posterior flange adapted to overlie the posterior portion of the shoulder on which the epaulet is worn. The anterior flange includes a lateral lobe, extending anteriorly and laterally, and the posterior flange includes a medial lobe, extending posteriorly and medially.

5 Claims, 2 Drawing Sheets

ORTHOTIC EPAULET FOR ALLEVIATING DISCOMFORT FROM BRASSIERE STRAPS

FIELD OF THE INVENTION

This invention relates to an orthotic device adapted to be worn on the shoulder to alleviate discomfort caused by brassiere straps.

BACKGROUND AND SUMMARY OF THE INVENTION

The discomfort caused by brassiere straps, particularly for large breasted women, is well known. While the brassiere straps on smaller breasted women tend to move laterally and fall off their shoulders, the brassiere straps on larger breasted women are pulled directly down onto the superior aspect of the shoulders. The force is proportional to the weight of the breast, and is concentrated by the very small, narrow, unidirectional path of the brassiere strap as it traverses the convex anatomy, producing essentially a "cheese-slicer" effect. At the day's end, the effects include a painful, irritated groove on the shoulder; neck and upper back pain; and a profound aching in her upper arms, sometimes accompanied by numbness and tingling in the hands.

The pain in the neck, upper back, and shoulders is largely due to the vertically downward force of the brassiere strap parallel to, but offset from, the vertical axis of the spine. This offset, which is the lateral distance between the spine and the brassiere strap, acts as a moment arm, causing a significant prolonged outward and downward rotational force on each shoulder simultaneously. The neck, upper back, and shoulder pain is the result of the prolonged effort of the muscles of the upper back to counter-balance these rotational forces. After hours of this sustained muscular effort, the muscles become painful and fatigued. Eventually these muscles allow more of the forces to be transmitted to the spine, which is the pivot or focal point for the rotational forces. This back pain is exacerbated in older women and women suffering arthritic changes to the spine.

The numbness in the hands some women experience is due to the downward component of the rotational force putting pressure on the clavicle. After muscle fatigue sets in toward the end of the day, and the muscles can no longer counter-balance this clavicular pressure, the pressure is then transmitted to the brachial plexus resulting in numbness of the hands.

Attempts have been made to alleviate brassiere strap discomfort, but these attempts have focused primarily on the irritation the brassiere straps cause on the shoulders. Thus the prior art attempts have generally been pads to protect the skin from the brassiere straps, and no attempt was made to deal with the bio-mechanical forces exerted by the brassiere straps on the neck, upper back, and shoulders. The prior art devices have generally been either too flimsy, too rigid, or subject to wrinkling or folding. More specifically the prior art devices generally were not anatomical; they relied upon a two-dimensional (rather than a three dimensional) concept of the forces applied to the shoulder; they relied on the fixed point of application of the forces; and they did not address all aspects of the problem, i.e., neck, back and arm pain, and numbness of the hands, in addition to the skin irritation caused by the straps. That these prior art devices have not provided a satisfactory solution to neck, back, and shoulder pain is perhaps best demonstrated by the fact that despite the relatively large number of such devices, none are in widespread use today.

Generally the orthotic epaulet of the present invention is adapted to be worn over the shoulder, and under the brassiere strap to protect the skin on the shoulder from bearing contact with the strap, and to biomechanically distribute the forces exerted by the strap to alleviate the discomfort caused by the forces applied by the brassiere strap. The orthotic epaulet of the present invention generally comprises a panel of a flexible material having a smoothly contoured perimeter. The panel is permanently smoothly curved in a direction perpendicular to a transverse ridge line to form a concave contact surface on the underside of the panel adapted to fit over the wearer's shoulder, and a convex bearing surface on the top surface of the panel, with the ridge line extending along the ridge of the wearer's shoulder. The panel is in effect divided along the ridge line into an anterior flange, which overlies the anterior portion of the shoulder when worn, and a posterior flange that overlies the posterior portion of the shoulder when worn. The posterior flange is preferably wider than the anterior flange. The panel is preferably irregularly shaped, having an anterior lateral lobe and a posterior medial lobe.

The epaulet further comprises a strip of a pile material extending transversely across the ridge line on the convex bearing surface of the panel, to engage a brassiere strap worn over the shoulder. The strip of pile material on the convex bearing surface is preferably a strip of the loop portion of a hook and loop type fastening material, such as Velcro®.

The panel is preferably made of a thermoplastic material that softens sufficiently at normal body temperature to conform closely to the body, while retaining sufficient rigidity to dissipate the forces applied by a brassiere strap over the surface area of the panel.

The shape and design of the orthotic epaulet takes into consideration the biomechanical forces applied to the shoulder and diffuses these forces by its thermoplastic properties, thus allowing itself to conform more closely to the body's anatomy and its anatomical responses to stress forces. The panel is initially formed pre-curved with an approximately 55° included angle between the anterior and posterior flanges. The orthotic epaulet is designed for one side of the body, with an epaulet for the left side being a mirror image of the epaulet for the right side.

A cloth liner may be secured, for example with an adhesive, on the concave contact surface for improved wearer comfort.

The orthotic epaulet of the present invention is quickly and easily placed on top of the shoulder under the brassiere strap. The orthotic epaulet remains in place strictly by the pressure of the brassiere strap. In aggressive sports activity a small piece of the mating hook portion of the hook and loop type fastening material can be attached to the underside surface of the brassiere strap, for example with a fabric adhesive, to further stabilize the epaulet, although this is not necessary for most activities. The orthotic epaulet is flexible and extremely light. As it rests under the brassiere strap in full flat opposition to the skin, the body temperature further softens the thermoplastic component just enough to allow it to accommodate to exact body contour but not to get too soft as to lose its stress diffusing ability.

The orthotic epaulet is preferably not attached to the brassiere strap so that the brassiere strap is free to translate across the ridge of the epaulet to a position where the forces are at equilibrium. This allows the epaulet to take into account various brassiere strap styles such as standard, non-angled, and raceback designs. The ability of the epaulet to allow the brassiere straps to translate to the equilibrium position on the shoulder allows the epaulet to dissipate the applied force over a larger area, and prevents groove-forming pressure beneath the brassiere strap. As the force of the brassiere strap is changed from directly vertical on top of the shoulder to translatory and angular, this decreases the size of the moment arm about the pivot point of the upper spine, thus reducing the rotational downward force on the shoulders. This means that the muscles in the neck, shoulders, and upper back do not have to work as hard to counteract the force applied by the brassiere straps, and consequently these muscles are less fatigued. This not only reduces muscle pain, but it reduces the amount of force the fatigued muscles allow to be transmitted to the spine.

Thus, the orthotic epaulet of the present invention is of simple and inexpensive construction. The epaulet is non-restrictive, allowing any activity at any age. The epaulet does not alter the contour of the shoulder, and is virtually invisible when worn under an opaque blouse. The epaulet is comfortable (the body does not recognize its wear similar to not recognizing the socks on the feet), does not bunch (because of the broad backed adhesive liner), has no seams (one piece liner construction). The epaulet is easy to clean and care for. The epaulet can be worn with virtually any brassiere design, including standard strap or race-back design.

The epaulet prevents brassier straps from forming grooves in the wearer's shoulders, or irritating the skin on the wearer's shoulders. Moreover, by diffusing the applied forces, and reducing the effective moment arm of these forces, the epaulet diminishes the neck, upper back, and shoulder pain, and the associated numbness and tingling of the hands. The epaulet can be worn and used by all women whether young, old, pregnant, sedentary or athletic. The epaulet can also be used by women who have had one breast removed and therefore suffer from asymmetric stresses on their neck, upper back, and shoulders. The epaulet can also help alleviate discomfort exacerbated by deformities, such as fractures of the clavicle.

The orthotic epaulet provides a possible alternative to breast reduction surgery which is many times necessary to relieve the symptoms of neck, back, and shoulder pain, and numbness and tingling of the hands. The epaulet also helps reduce or eliminate drug dependency caused by the unrelieved symptoms of neck, back, and shoulder pain.

BRIEF DESCRIPTION OF THE DRAWINGS

Corresponding reference numerals indicate corresponding parts throughout the several views of the drawing.

DETAILED DESCRIPTION OF THE PREFERRED EMBODIMENT

Figure 1:
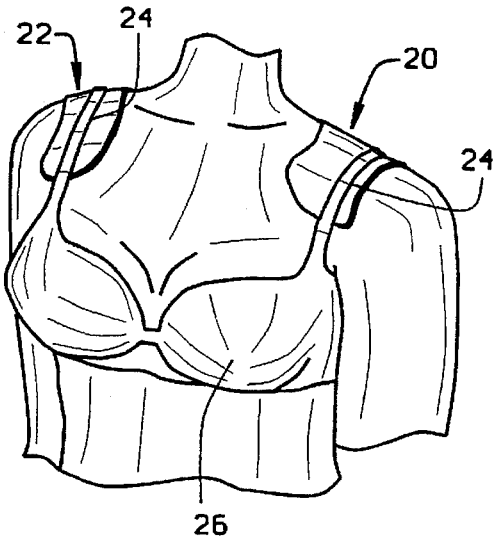
FIG. 1 is a front perspective view of the torso of a woman wearing a raceback brassiere, utilizing a pair of orthotic epaulets of the present invention.
Figure 3:
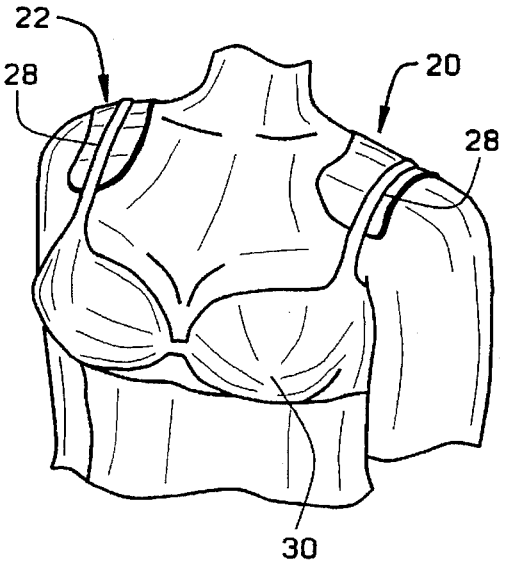
FIG. 3 is a front perspective view of the torso of a woman wearing a standard brassiere, utilizing a pair of orthotic epaulets of the present invention.
Figure 2:
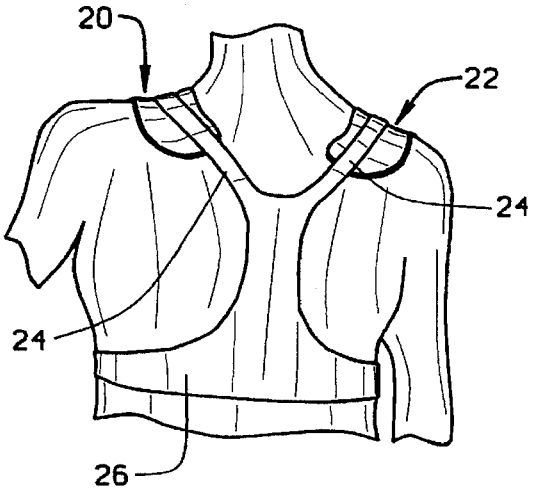
FIG. 2 is a rear perspective view of the torso of a woman wearing a raceback brassiere, utilizing a pair of orthotic epaulets of the present invention.
Figure 4:
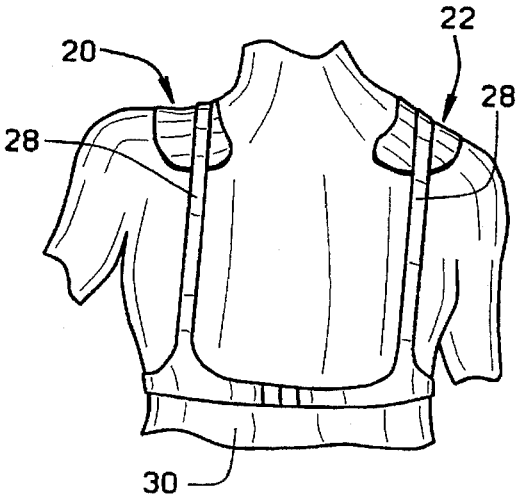
FIG. 4 is a rear perspective view of the torso of a woman wearing a standard brassiere, utilizing a pair of orthotic epaulets of the present invention.

A pair of left and right orthotic epaulets constructed according to the principles of this invention, indicated generally as 20 and 22, are shown in FIGS. 1 and 2 as they would be worn on the shoulders of a woman to alleviate discomfort from the straps 24 of a raceback brassiere 26. Similarly, in FIGS. 3 and 4, the pair of left and right orthotic epaulets 20 and 22 are shown as they would be worn on the shoulders of a woman to alleviate discomfort from the straps 28 of a standard brassiere 30.

Figure 5:
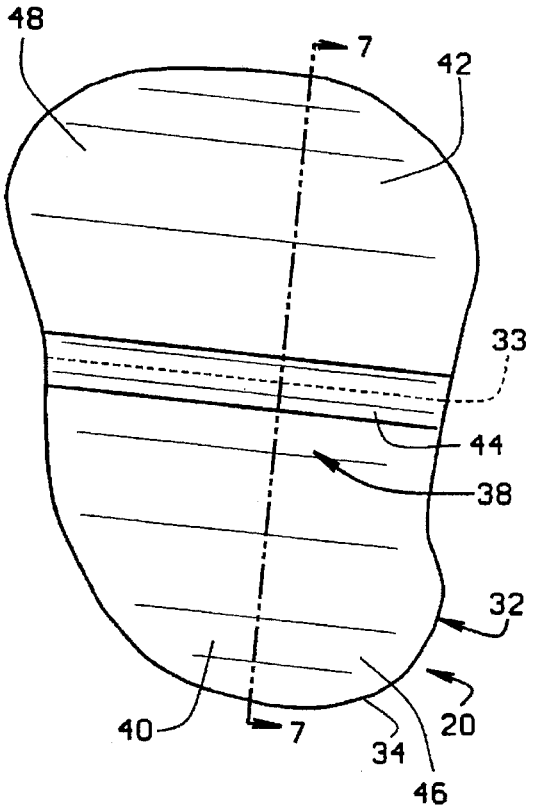
FIG. 5 is a top plan view of a left side orthotic epaulet constructed according to the principles of this invention.
Figure 6:
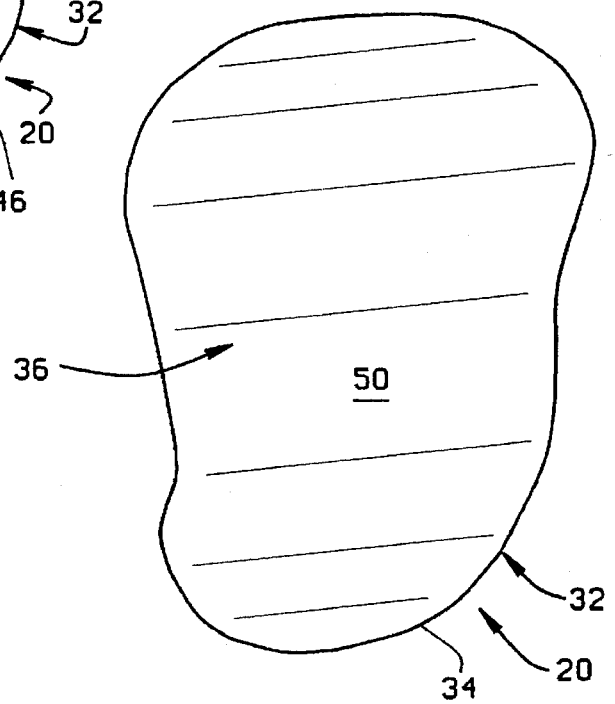
FIG. 6 is a bottom plan view of the orthotic epaulet shown FIG. 5.
Figure 7:
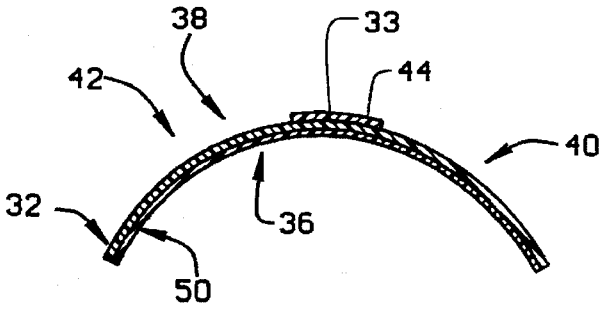
FIG. 7 is a vertical cross section of the orthotic epaulet taken along the plane of line 7—7 in FIG. 5.

The left and right orthotic epaulets of the present invention are of identical construction, the only difference being that left epaulet 20 and right epaulet 22 are mirror images of one another. The left epaulet 20 is shown in FIGS. 5–7. The epaulet 20 comprises a panel 32 of a flexible material having a smoothly contoured perimeter 34. The panel 32 is smoothly curved from the anterior edge to the posterior edge across a transverse ridge line 33. The panel 32 has a concave contact surface 36 on its underside, adapted to fit over the user's shoulder, and a convex bearing surface 38 on its top surface. The ridge line extends across the ridge of the wearer's shoulder, and divides the epaulet into an anterior flange 40 and a posterior flange 42. The anterior flange 40 is adapted to overlie the anterior portion of the shoulder on which the epaulet is worn, and the posterior flange is adapted to overlie the posterior portion of the shoulder on which the epaulet is worn. The posterior flange 42 is preferably wider, i.e., it extends longer in the lateral-medial direction, than the anterior flange.

The panel 32 is preferably made from a thermoplastic material that softens sufficiently at body temperature that the epaulet 20 closely conforms to the wearer's shoulder, for greater comfort and maximum force distribution. However, the thermoplastic preferably remains sufficiently rigid that it can still effectively distribute forces from the brassiere strap over the surface of the epaulet 20. The panel is preferably made of a low density polyethylene sheet material, for example Resinol, "type A" sold by American Plastics Co. In the preferred embodiment the plastic is 0.1 cm thick. This plastic can be permanently distorted at 110° F., and at normal body temperature (98.6° F.) allows the plastic to elastically deform to conform to the wearer's shoulder.

A strip 44 of a cloth pile material extends transversely across the ridge line 33 on the convex bearing surface 38. This pile material is preferably a ¾ inch wide strip of the loop potion of a hook and loop type fastening material, such as Velcro®.

The anterior flange 40 includes a lateral lobe 46, extending anteriorly and laterally, i.e., the anterior flange extends further in the lateral direction than in the medial direction. The posterior flange 42 preferably includes a medial lobe 48 extending posteriorly and medially, i.e., the posterior flange extends further in the medial direction than in the lateral direction. This gives the panel 22 serpiginous or reversed "S" shape. In fact, the shape of the panel can be considered to be a "morphed" S to allow the angular transitory forces against the ridge 33 to be applied to the epaulet at maximum advantage.

A cloth liner 50 can be secured on the concave contact surface 36, to improve the comfort of the epaulet. The liner 50 is preferably a seamless sheet of material, such as Moleskin Plus™ from Schering-Plough Health Care Products, Inc., so that there are no joints or seams to cause discomfort to the wearer. The liner is preferably 0.1 cm thick. The liner 50 is not necessary to the function of the epaulet, but acts as an interface to prevent maceration of the skin secondary to sweat entrapment beneath a non-porous, non-absorbing substance, such as the panel 32. Therefore the epaulet does not function merely as a pad.

In the preferred embodiment of the orthotic epaulet, the epaulet measures 12 cm from the anterior edge to the posterior edge. The epaulet measures 8 cm at the ridge line. The center of the epaulet is the point 6 cm from the anterior edge and 6 cm from the posterior edge, and 4 cm. from the lateral edge and 4 cm from the medial edge at the ridge. From the center line point, the anterior lateral lobe extends 6.2 cm at an angle of 25° lateral of the anterior posterior centerline. The posterior medial lobe extends 6.7 cm from the center point at an angle 30° medial of the anterior posterior center line.

Operation

The orthotic epaulets 20 and 22 of the present invention are quickly and easily put on. The left epaulet 20 is simply placed on the left shoulder, with the strip 44 extending generally along the ridge of the shoulder. Similarly, the right epaulet 22 is simply placed on the right shoulder, with the strip 44 extending generally along the ridge of the shoulder. The brassiere straps, for example straps 24 of brassiere 26, or straps 28 of brassiere 30, are placed over the epaulets 20 and 22.

The straps 24 or 28 can translate along the strip 44 on each epaulet until they reach a point where the forces are balanced. At this point the forces applied downwardly to the shoulder are distributed by the epaulet over substantially the entire surface of epaulet, rather than over the much smaller surface area of the strap. Thus the force per unit area is reduced, and the irritation of the shoulder. However, by allowing the strap to translate and finding an equilibrium position, the epaulet also reduces the effective moment arm of the point of application of the brassier strap forces, thereby reducing the amount of counter force the muscles must apply. This reduces muscle fatigue and the amount of force transmitted to the spine.

The smooth contours of the epaulets eliminate stress concentrating corners that could impinge the skin, and the anterior lateral lobe and the posterior medial lobe of the epaulet provide the greatest bearing surface over the likely positions of the brassier strap. The absence of material on the medial side of the anterior flange eliminates the possibility of rubbing or irritating the breast. Similarly, the absence of material on the lateral side of the posterior flange eliminates the possibility of rubbing or irritating the back of the shoulder.

What is claimed is:

1. An orthotic epaulet adapted to be worn on the shoulder to alleviate discomfort caused by brassiere straps, the epaulet comprising:

a panel of flexible material having an underside surface, a top surface, and a smoothly contoured perimeter, the panel being smoothly curved across a transverse ridge line to form a concave contact surface on the underside of the panel adapted to fit over the wearer's shoulder, and a convex bearing surface on the top surface of the panel, with the ridge line extending along the ridge of the wearer's shoulder, the panel having an anterior flange adapted to overlie the anterior portion of the shoulder on which the epaulet is worn, and a posterior flange adapted to overlie the posterior portion of the shoulder on which the epaulet is worn, the anterior flange extending further in the lateral direction than the medial direction and having a lateral lobe extending anteriorly and laterally; and the posterior flange extending farther in the medial direction than the lateral direction, and having a medial lobe extending posteriorly and medially, the panel being made from a thermoplastic material that softens sufficiently at body temperature to conform closely to the wearer's body, but which retains sufficient stiffness to distribute the loading from a brassiere strap over the surface of the panel; and a strip of pile material extending transversely across the convex bearing surface of the panel along the ridge line, to engage a brassiere strap worn over the shoulder.

2. The orthotic epaulet according to claim 1 wherein the strip of pile material is a strip of the loop portion of a hook and loop type fastening material.

3. The orthotic epaulet according to claim 1 wherein the posterior flange is wider than the anterior flange.

4. The orthotic epaulet according to claim 1 wherein the thermoplastic material is a low density polyethylene sheet material.

5. The orthotic epaulet according to claim 1 further comprising a cloth liner on the concave/context surface.

* * * * *